US007325687B2

(12) United States Patent
Bravo et al.

(10) Patent No.: US 7,325,687 B2
(45) Date of Patent: Feb. 5, 2008

(54) STORAGE AND DISPENSING CONTAINER FOR PAINT

(75) Inventors: Michael H. Bravo, Needham, MA (US); Craig M. Rowles, Hartford, CT (US); John P. Sullivan, Oakville (CA); David Markham, Pittsford, NY (US); Mark W. Scott, Bethany, CT (US); Chris Van Buiten, Oxford, CT (US); Gregory J. Mascoli, Haddam, CT (US); Robert Slack, Jupiter, FL (US); Corinna Lee, Laca, CA (US)

(73) Assignee: The Sherwin-Williams Company, Cleveland, OH (US)

( * ) Notice: Subject to any disclaimer, the term of this patent is extended or adjusted under 35 U.S.C. 154(b) by 289 days.

(21) Appl. No.: 10/940,012

(22) Filed: Sep. 14, 2004

(65) Prior Publication Data

US 2005/0028884 A1 Feb. 10, 2005

Related U.S. Application Data

(63) Continuation of application No. 10/449,231, filed on May 30, 2003, which is a continuation of application No. 10/313,230, filed on Dec. 5, 2002, now Pat. No. 6,634,525, which is a continuation of application No. 09/349,894, filed on Jul. 8, 1999, now Pat. No. 6,530,500.

(51) Int. Cl.
*B65D 21/036* (2006.01)
*B65D 25/14* (2006.01)
*B65D 25/30* (2006.01)

(52) U.S. Cl. ..... 206/509; 206/508; 220/495.02; 220/23.6; 220/608; 220/771

(58) Field of Classification Search ..... 206/508–512, 206/503; 220/495.02, 23.6, 304, 608, 23.2, 220/771, 752, 755, 768
See application file for complete search history.

(56) References Cited

U.S. PATENT DOCUMENTS

| | | | |
|---|---|---|---|
| D34,895 | S | 8/1901 | McFaddin |
| 2,194,486 | A | 3/1940 | Straub |
| 2,324,338 | A | 7/1943 | Tripp |
| 2,659,519 | A | 11/1953 | Allen |
| 2,707,574 | A | 5/1955 | Klebenow |
| 2,743,844 | A | 5/1956 | Livingstone |
| 2,763,402 | A | 9/1956 | Livingstone |
| 2,817,465 | A | 12/1957 | Gray |
| 2,851,196 | A | 9/1958 | Livingstone |
| 2,889,654 | A | 6/1959 | La Fever |
| 2,889,954 | A | 6/1959 | Tozier |

(Continued)

OTHER PUBLICATIONS

Copyright 1990 The Financial Times Limited Financial Times (London)—Jan. 4, 1990—3 pages.

(Continued)

*Primary Examiner*—Anthony D. Stashick
*Assistant Examiner*—Niki M. Eloshway
(74) *Attorney, Agent, or Firm*—Oblon, Spivak, McClelland, Maier & Neustadt, P.C.

(57) ABSTRACT

An improved container for storing, dispensing and handling viscous and semi-viscous fluids such as paint and the like, having novel spout and other design features that enable substantially dripless dispensing and improved handling and storage.

18 Claims, 5 Drawing Sheets

U.S. PATENT DOCUMENTS

| | | | |
|---|---|---|---|
| 3,000,527 | A | 9/1961 | Jennings et al. |
| D192,886 | S | 5/1962 | Kaplan |
| 3,113,706 | A | 12/1963 | Wickman |
| D206,407 | S | 12/1966 | Sharp |
| 3,310,088 | A | 3/1967 | Hildebrandt et al. |
| D207,466 | S | 4/1967 | Phillips |
| 3,313,438 | A | 4/1967 | Piker |
| 3,387,749 | A | 6/1968 | Godshalk et al. |
| D211,928 | S | 8/1968 | Burnett |
| D217,231 | S | 4/1970 | Pashman |
| D221,515 | S | 8/1971 | Betka |
| 3,612,595 | A | 10/1971 | Updegraff et al. |
| 3,620,410 | A | 11/1971 | Griese, Jr. |
| 3,625,386 | A | 12/1971 | Schaefer |
| 3,659,758 | A | 5/1972 | Waterman |
| 3,695,488 | A | 10/1972 | Olsson |
| 3,727,792 | A | 4/1973 | Levin |
| 3,744,671 | A | 7/1973 | Saunders, Jr. |
| 3,807,679 | A | 4/1974 | Burke et al. |
| 3,899,107 | A | 8/1975 | Gaal |
| 3,927,797 | A | 12/1975 | Flider |
| 3,945,527 | A | 3/1976 | Pylant |
| 4,014,465 | A | 3/1977 | Ritter |
| 4,022,352 | A | 5/1977 | Pehr |
| 4,061,242 | A | 12/1977 | Donlon |
| 4,078,700 | A | 3/1978 | Hidding |
| 4,128,189 | A | 12/1978 | Baxter |
| D250,806 | S | 1/1979 | Gutkowski |
| 4,150,763 | A | 4/1979 | Simpson |
| 4,203,537 | A | 5/1980 | McAlister |
| 4,225,064 | A | 9/1980 | Westcott |
| 4,240,568 | A | 12/1980 | Pool |
| 4,245,753 | A | 1/1981 | Ellis |
| D258,563 | S | 3/1981 | Romagnoli |
| D261,362 | S | 10/1981 | Epperson |
| 4,312,459 | A | 1/1982 | Leach |
| 4,386,701 | A | 6/1983 | Galer |
| 4,387,828 | A | 6/1983 | Yates, Jr. |
| 4,387,922 | A | 6/1983 | Geisinger |
| D269,948 | S | 8/1983 | Janssen |
| 4,399,926 | A | 8/1983 | Eidels-Dubovoy |
| 4,453,647 | A | 6/1984 | Neat |
| 4,457,458 | A | 7/1984 | Heinol |
| 4,458,819 | A | 7/1984 | Geiger |
| D276,890 | S | 12/1984 | Hancher |
| 4,491,234 | A | 1/1985 | Wilcock |
| 4,494,674 | A | 1/1985 | Roof |
| 4,520,936 | A | 6/1985 | Lyons |
| D279,763 | S | 7/1985 | Hestehave et al. |
| 4,541,529 | A | 9/1985 | Hestehave et al. |
| 4,548,332 | A | 10/1985 | Neat |
| D281,579 | S | 12/1985 | Drummond, Jr. et al. |
| 4,583,666 | A | 4/1986 | Buck |
| 4,619,373 | A | 10/1986 | Galer |
| D289,377 | S | 4/1987 | Ashby et al. |
| 4,664,295 | A | 5/1987 | Iida |
| 4,671,421 | A | 6/1987 | Reiber et al. |
| 4,702,395 | A | 10/1987 | Nitsch |
| 4,706,829 | A | 11/1987 | Li |
| 4,735,313 | A | 4/1988 | Schoenberg |
| 4,736,874 | A | 4/1988 | Durant |
| D296,873 | S | 7/1988 | Dent et al. |
| 4,771,501 | A | 9/1988 | Leiter |
| 4,773,560 | A | 9/1988 | Kittscher |
| 4,805,793 | A | 2/1989 | Brandt et al. |
| 4,830,234 | A | 5/1989 | Odet |
| D304,014 | S | 10/1989 | O'Connell |
| D305,407 | S | 1/1990 | Gonda |
| 4,893,723 | A | 1/1990 | Seabolt |
| 4,899,885 | A | 2/1990 | Van Koert |
| 4,911,319 | A | 3/1990 | DeJean |
| D307,389 | S | 4/1990 | Larson |
| 4,917,268 | A | 4/1990 | Campbell et al. |
| 4,927,046 | A | 5/1990 | Armstrong |
| 4,928,860 | A | 5/1990 | Knight |
| D309,260 | S | 7/1990 | Conrad |
| 4,941,815 | A | 7/1990 | Julian |
| 4,949,884 | A | 8/1990 | Dahl |
| 4,974,749 | A | 12/1990 | Mon |
| D313,350 | S | 1/1991 | Beaver |
| 4,984,714 | A | 1/1991 | Sledge |
| 4,993,605 | A | 2/1991 | Del'Re |
| 5,020,692 | A | 6/1991 | Darr |
| D318,228 | S | 7/1991 | Schlesselman |
| D320,345 | S | 10/1991 | Hamly et al. |
| 5,054,661 | A | 10/1991 | Hollje |
| D321,624 | S | 11/1991 | Fiore et al. |
| 5,064,101 | A | 11/1991 | Richter et al. |
| D323,115 | S | 1/1992 | Kelsey |
| 5,092,474 | A | 3/1992 | Leigner |
| 5,092,478 | A | 3/1992 | La Pierre |
| 5,105,858 | A | 4/1992 | Levinson |
| 5,108,009 | A | 4/1992 | Davidson et al. |
| D332,747 | S | 1/1993 | Darr et al. |
| 5,188,249 | A | 2/1993 | Cargile |
| 5,207,356 | A | 5/1993 | Krall |
| D336,434 | S | 6/1993 | Binder |
| D338,407 | S | 8/1993 | Lynd |
| 5,234,130 | A | 8/1993 | Benioff et al. |
| 5,269,438 | A | 12/1993 | Kelsey |
| 5,299,710 | A | 4/1994 | Welsch et al. |
| 5,314,061 | A | 5/1994 | Bedrossian |
| 5,322,662 | A | 6/1994 | Benioff et al. |
| D349,651 | S | 8/1994 | Saffer |
| D352,459 | S | 11/1994 | Pollacco |
| 5,377,858 | A | 1/1995 | Morris, Sr. |
| 5,383,558 | A | 1/1995 | Wilkinson et al. |
| D355,366 | S | 2/1995 | Bainton |
| 5,390,805 | A | 2/1995 | Bilani et al. |
| 5,401,200 | A | 3/1995 | Ellis |
| 5,409,128 | A | 4/1995 | Mitchell |
| D358,333 | S | 5/1995 | Stockwell et al. |
| 5,431,306 | A | 7/1995 | Reid |
| D360,830 | S | 8/1995 | Hestehave et al. |
| D362,180 | S | 9/1995 | Haines |
| 5,492,240 | A | 2/1996 | Vilutis |
| D370,153 | S | 5/1996 | Chaney et al. |
| D370,850 | S | 6/1996 | Beaver |
| D372,197 | S | 7/1996 | Gough |
| D374,178 | S | 10/1996 | Valls et al. |
| 5,566,861 | A | 10/1996 | Serano |
| 5,566,862 | A | 10/1996 | Haffner et al. |
| 5,577,626 | A | 11/1996 | Henkel et al. |
| D376,761 | S | 12/1996 | Lathrop et al. |
| 5,603,787 | A | 2/1997 | Reid |
| D379,302 | S | 5/1997 | Rodman |
| 5,626,258 | A | 5/1997 | Maiorino |
| 5,669,526 | A | 9/1997 | Keyfauver |
| 5,678,684 | A | 10/1997 | Wright |
| 5,699,925 | A | 12/1997 | Petruzzi |
| D389,067 | S | 1/1998 | Lown |
| 5,704,502 | A | 1/1998 | Greenfield |
| D392,188 | S | 3/1998 | Darr et al. |
| 5,743,425 | A | 4/1998 | Ellis |
| 5,775,483 | A | 7/1998 | Lown et al. |
| 5,794,803 | A | 8/1998 | Sprick |
| 5,823,345 | A | 10/1998 | Nask et al. |
| D401,154 | S | 11/1998 | Robinson |
| D403,243 | S | 12/1998 | Takeuchi et al. |
| 5,850,953 | A | 12/1998 | Dallas, Jr. |
| 5,855,299 | A | 1/1999 | Arnold et al. |
| 5,855,304 | A | 1/1999 | Dean et al. |
| 5,868,283 | A | 2/1999 | Wilson et al. |
| 5,875,942 | A | 3/1999 | Ohmi et al. |

| | | | |
|---|---|---|---|
| 5,893,489 | A | 4/1999 | Giarrante |
| 5,896,993 | A | 4/1999 | Nask et al. |
| 5,908,136 | A | 6/1999 | Mrak |
| 5,941,427 | A | 8/1999 | Spear |
| 5,964,383 | A | 10/1999 | Cargile |
| 5,975,346 | A | 11/1999 | Imperato et al. |
| 6,029,858 | A | 2/2000 | Srokose et al. |
| 6,029,864 | A | 2/2000 | Nilsson et al. |
| D422,920 | S | 4/2000 | Tapp et al. |
| 6,059,153 | A | 5/2000 | Olson et al. |
| 6,068,161 | A | 5/2000 | Soehnlen et al. |
| 6,085,949 | A | 7/2000 | Zimny et al. |
| D428,817 | S | 8/2000 | Olson et al. |
| 6,123,231 | A | 9/2000 | Geisinger |
| 6,209,762 | B1 | 4/2001 | Haffner et al. |
| 6,223,945 | B1 | 5/2001 | Giblin et al. |
| D449,535 | S | 10/2001 | Geisinger et al. |
| 6,412,661 | B1 | 7/2002 | Hannah, Sr. |
| 6,530,500 | B2 | 3/2003 | Bravo et al. |
| 2003/0111489 | A1 | 6/2003 | Bravo et al. |

OTHER PUBLICATIONS

Copyright 1994 Information Access Company, a Thompson Corporation Company—Oct. 13, 1994.
Invitation to class room presentation to be made May 9, 1998.
Spring 1998 Project Schedule, Project Design and Development, MIT Professor Steven Eppinger.
Modern Paint and Coatings, v28, n7, p(28), article entitled "Manufacture keeping pace with paint container market", 4 pages, Feb. 1992.
Packaging Week, v8, n30, p. 6, article entitled "Dulux relaunches paint in a user friendly can", 1 page, Jan. 1993.
Modern Paint and Coatings, "Plastic Paint Container: Has It's Time Finally Come?", pp. 177, 178, and 180, Oct. 1993.
Packaging Week, "Container Stands by its Design", p. 21, Nov. 7, 1990.
Packaging Week, "Bristling With New Ideas", p. 21, Nov. 7, 1990.
Packaging Week, "Developments in Paint Packaging", vol. 181, No. 4279, p. 153, Mar. 20, 1991.
Packaging Week, "Confident Approach by RPC", pp. 16 and 17, Jun. 19, 1991.
Article entitled: "Marktgerechtes Verpackungsdesign", pp. 688 and 689, Jun. 1991.
The Best in Specialist Packaging Design, Article entitled: :Lens Sensations, 4 pages, 1993.
Packaging Week, "Breathing new life into old favorites", pp. 20 and 21, Oct. 13, 1994.
Cambridge Scientific Abstracts, pp. 1 through 51, Oct. 3, 2003.
Packaging Week, "Reed Invests in PET Paint Cans", 1 page, Feb. 3, 1990.
Emballanges Magazine, "Avi announce la coulert!", p. 17, Nov. 1990.
Food Engineering, "Dripless pouring for flowable foods", 2 pages, Jan. 1977.
Packaging Week, "Reed Moves into PET with Paint Container", vol. 5, Issue 33, 1 page, Jan. 3, 10, 1990.
Packaging Week, "Another brush with success for Mardon", p. 24, Jul. 1985.
Packaging Week "Crown claims first for paint packaging", p. 11, Sep. 27, 1989.
Packaging Week "Field unveils 2-litre flat-top paint carton", vol. 11, Issue 2, 1 page, May 18, 1995.
Packaging Week "Dulux relaunches paint in a user friendly can", p. 6, Jan. 20, 1993.
Packaging, "How plastics cans can take on paint", 1 page, Aug. 1983.
Packaging Review, "What Price Paint in PP Pails?", vol. 100, No. 5, 1 page, Mar. 1980.
Modern Paint and Coatings, "Manufacturers Keeping Pace with Paint Container Market", vol. 82, No. 2, 4 pages, Feb. 1992.
Financial Times (London), article entitled "Packaging—Crown; cleaning up in the UK paint market", 3 pages, Jan. 1990.
Canadian Packaging, article entitled "Cap-ital idea", 2 pages, Jun. 1993.
Packaging Digest, article entitled "Laundry products wear washoff labels", 3 pages, Jan. 1994.
The Ottawa Citizen, article entitled "by design", 2 pages, Aug. 19, 1955.
San Antonio Express—News (Texas), article entitled "Inventor gets wrenching lessons about business", 3 pages, Dec. 8, 1996.
Chicago Tribune, article entitled "Off The Wall; Brush Up On The Latest Tools For Paint Cleanup", 2 pages, Mar. 19, 1999.
Article entitled "Polypropylene in Packaging", Packaging, 12 pages, Apr. 1993.
Article entitled "Dulux pick a winner"; Packaging, 2 pages, Apr. 1993.
Michael H.Bravo, et al. "The Paint Jug: A Revolution In Painting" 2-sided brochure, May 1998.
MIT Sloan School of Management & School of Engineering and RISD Industrial Design, 1 page, invitation for Saturday, May 9, 1998, date approx, Apr. 1998.
Massachusetts Institute of Technology, Pridcut Design and Development, Spring 1998, Project Schedule, 3 pages, date approx. Jan. 1998.
Massachusetts Institute of Technology, Prodcut Design and Development, Spring 1998, General Information, 4 pages, date approx. Jan. 1998.
Spring 1998 General Information, Project Design Development, MIT Proffessor Steven Eppinger.
Internet Search: DoitBest.com entitled "paint & supplies", 2 pages, date unknown.
Internet Search: AircraftSpruce.com entitled "pouring pal clip on pour spout", 2 pages, date unknown.

Lid (16)

Jug Body (24)

STORAGE AND DISPENSING CONTAINER FOR PAINT

CROSS-REFERENCE TO RELATED APPLICATION

This application is a continuation of U.S. patent application Ser. No. 10/449,231, filed on May 30, 2003, which is a continuation of U.S. patent application Ser. No. 10/313,230, filed on Dec. 5, 2002, now U.S. Pat. No. 6,634,525, which was, in turn, a continuation of U.S. patent application Ser. No. 09/349,894, filed on Jul. 8, 1999, now U.S. Pat. No. 6,530,500, issued on Mar. 11, 2003, the entirety of all these applications is hereby incorporated by reference.

BACKGROUND OF THE INVENTION

The present invention relates to containers for viscous and other fluids and to improvements in the containment, dispensing and handling of the fluids; being more particularly, though not exclusively, concerned with architectural coatings such as paints and the like and to significant improvement in current paint can design.

Nearly all one-gallon and smaller containers of paint are sold in cylindrical metal cans having an upper edge with a groove that accepts the annular protrusion of a high friction metal lid secured by a press fit. This arrangement has many operational drawbacks that the industry has put up with for many decades. These include the lack of a locking mechanism that would prevent the friction lid, popping off if the can is dropped from a height as little as one meter, with consequent spilling of the contents widely on the ground. The lid, moreover, must be pried off with a tool to gain access to the paint, which proves a problem if no tool is available. The prying action, moreover, often damages the lid sealing surface. The can lip, furthermore, makes a very poor spout. When the paint contents are transferred to another container, they must be poured across the grooved upper edge of the can, which inherently retains some of the paint, and the paint running down the outside of the can often obscure the label, potentially reaching the users hands and the bottom surface. The can, indeed, must be wiped nearly every time it is poured. With the inside of the upper rim trapping paint as it is poured, the user is never able to extract all available paint even if a brush is used. The circular shape of the can opening, in addition, is ineffective for wiping a flat brush clean of excess paint. Every time paint is poured from a can, the groove that accepts the lid fills with paint and it is very difficult to clean completely. After repeated opening, pouring, and closing, in addition, the mating surface becomes fouled and the friction seal fails.

Perhaps the biggest drawback of the current paint can, however, resides in the splattering of paint from the groove as the lid is pounded back on. The pounding of the lid often damages both sealing surfaces, which again can cause the seal to fail. Furthermore, paint in and around the groove can dry out and flake, leading to paint contamination each time the can is jostled. While metal cans are coated to prevent rust, this coating often fails, which leads to rust and paint contamination. Paint cans, in addition, do not stack well, and little disturbance is needed to cause them to slide off of one another.

Many efforts have been made to address these and other problems associated with the conventional metal paint can. Some prior are improvements remedy to some degree some of the shortcomings mentioned above, but none, until the present invention, has effectively solved even a majority of these problems.

As an example, U.S. Pat. No. 5,669,526 discloses a plastic paint can that has a small-diameter, collapsible spout, non-contaminating lid seal, and straight edge formed in the can opening to facilitate brush wiping. This configuration, however, only addresses problems of paint contamination, messy pouring, and non-uniform brush wiping inherent in the conventional metal paint can. The narrow spout opening causes a slow pour rate and an undesirable chugging action as contents are poured.

U.S. Pat. No. 5,269,438 discloses a container with features designed to improve dispensing, such as a pivotally mounted carrying handle that is offset from the opening to provide access. It also has a wide pouring channel to improve flow, addressing to some degree a number of deficiencies. The pop top of the lid, however, is not very secure and the spout does not prevent paint running down the side of the container.

A plastic container having a threaded lid that closes the container either by screw-down or snap-on action is proposed in U.S. Pat. No. 4,453,647. A depression is formed in the lid to accept a mixing stick or the like to aid in tightening and undoing the lid. This configuration, however, only addresses the problems of paint contamination and the difficult opening and closing of the lid inherent in the conventional metal paint can. As the contents are poured, they can still coat container threads and run down the side of the container. A tool, in particular a paint mixing stick, not always available, is required, moreover, to open the lid.

In U.S. Pat. No. 4,917,268, there is disclosed a liquid-dispersing package with a spout that has a drain back channel to return liquid drips to the container. This configuration, however, only addresses the problem of difficult, messy pouring inherent in containers intended for dispensing low viscosity liquids, but it does not work will with moderate viscosity fluids, such as paint. The tall and narrow design, moreover, eliminates the stackability of the container.

U.S. Pat. No. 5,054,661, as another illustration of attempts to improve the pouring operation, discloses a pouring spout that extends outwardly of the upper edge of the container, and an opposing handle projected from the upper edge of the container. It is also primarily intended to facilitate dispensing of paint during painting. In this invention, however, there is also no means to store the paint, and any unintended spillage during pouring will also wet exterior surfaces.

U.S. Pat. No. 4,619,373 discloses a plastic paint container with a lid that seals within the inner diameter of the rim at the top of the container, to eliminate the poor sealing characteristics of the friction lid of the metal paint can. It is still subject, however, to contamination of the seal by the paint itself, and does not provide for clean use or dispensing.

Another proposal, in U.S. Pat. No. 4,245,753 also provides a plastic paint container, but with a snap-on, screw-off type of lid. It also provides a stacking construction and a hollow handle. The design addresses the sealing and opening/closing problem with the metal paint can friction lid, and aids in stacking containers together. Like the other prior art, however, it does not provide for clean dispensing or use, nor does it address the difficulty that would be encountered with hand rotation of a firmly engaged, large diameter friction seal lid.

Numerous other prior art proposals provide for attaching auxiliary components to existing metal cans. Attachments are inherently deficient because they all require the additional operations of the attachment, removal, and cleaning which are inconvenient to the user. For example, U.S. Pat. No. 4,702,395 discloses a handle and pouring-spout arrangement intended for attachment to a conventional metal paint can. The spout has an optional paint-drainback section. This configuration, moreover, only attempts to solve the problem of difficult, messy pouring from conventional metal paint cans.

In U.S. Pat. No. 4,949,884, as another illustration, a removable top to a conventional metal can is proposed to attempt to solve these problems of difficult, messy pouring from conventional paint cans. Again, it must be attached and removed not only for every opening and closing, respectively, but also every time a brush is to be used.

While the above-mentioned advances in the art each solve to some degree some of the major problems inherent in the conventional metal paint can, none of them solves a majority of the problems. Some, moreover, improve only a subset of the problems and make improvements at the expense of some current favorable can features. The present invention, on the other hand, synergistically solves nearly all of the major problems above-enumerated inherent in the conventional metal paint can.

SUMMARY OF THE INVENTION

A primary object of the invention, accordingly, is to provide a new and improved paint container for minimizing paint dripping and, in addition, simultaneously obviating the other previously described handling and operational disadvantages of current paint can containers.

Other and further objects will be explained hereinafter and are more particularly delineated in the appended claims.

In accordance with the present invention, a paint storage and dispensing product is provided. The product includes a plastic body defining an interior volume. The body has a bottom portion including a bottom wall and at least one side wall. A top collar is joined to the bottom portion. The collar has an enlarged opening extending therethrough for accessing the interior volume. A bail-type swing handle is connected to the body for holding the container. The swing handle has a grasp portion that is movable between a downward stowed position, wherein the grasp portion is disposed against the body and an upward carrying position, wherein the grasp portion is spaced above the body. A pouring guide is disposed in the collar and includes a pour spout extending upwardly above the collar to enable pouring of paint over the collar. A cap is engageable with the collar to close the opening. The cap has an interior height sufficient to accommodate the pour spout when the cap is engaged with the collar.

The paint and storage dispensing product preferably has two pairs of opposing side walls that are joined at rounded corners to provide at least part of the bottom portion of the body with a rectangular cross-section with rounded corners. Preferably an integral handle is formed in the bottom portion of the body at one of the corners.

BRIEF DESCRIPTION OF THE DRAWINGS

The invention will now be described in connection with the accompanying drawings, in which.

DETAILED DESCRIPTION OF THE PREFERRED EMBODIMENTS

Figure 1:
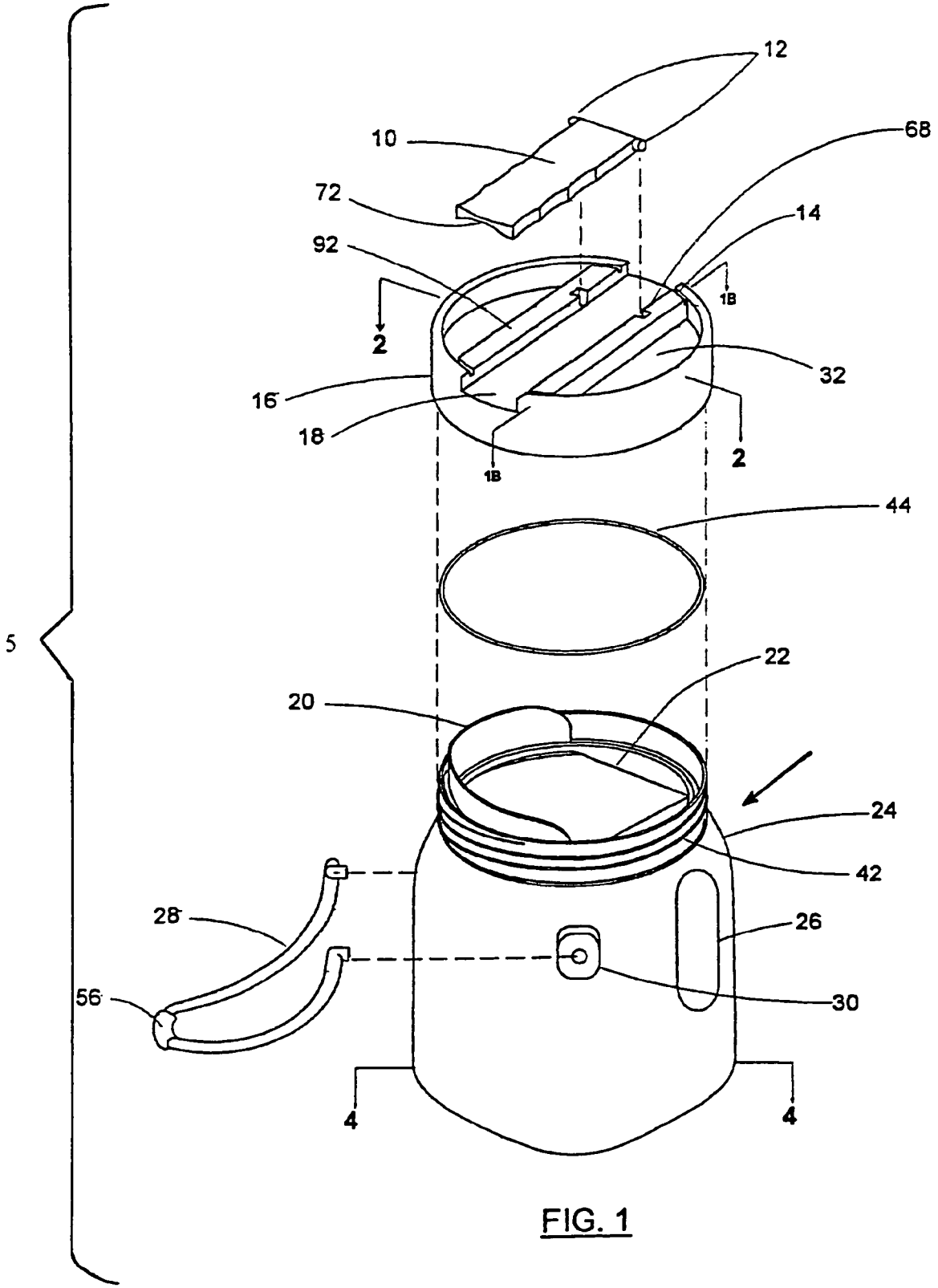
FIG. 1 is an isometric view of the container main parts and features as shown from one side in exploded form.

A container 5 embodied in accordance with the present invention is illustrated in FIG. 1 in exploded part format. The container 5 has a jug-like body 24, preferably of one-piece plastic construction. The jug body 24 may be blow-molded and made of high-density polyethylene (HDPE), and can be made resistant to oil-based materials and the like by treating the interior with a process such as fluorination. It has a plastic screw-type lid 16, a flip handle 10 with two cylindrical, mounting hinge pins 12 protruding from its sides on one end. Both the lid 16 and flip handle 10 can be made of commonly available strong, plastic materials such as HDPE, ABS or PVC. Both can be injection molded or fabricated from stock. The preferred embodiment of the container 5 also has a rigid swing handle 28 externally mounted onto the body 24 at its ends, and an optional swing handle grasp pad 56 which fits around the middle of the swing handle 28. The swing handle 28 is made of strong, corrosion-resistant metal such as aluminum or stainless steel. The grasp pad 56 is made of a soft, resilient plastic or dense foam rubber-type material, and is installed either by sliding over the end of the swing handle 28 or through a slit in the grasp. The swing handle 28 is contoured so that it conforms to the outside of the jug body 24 when it is in the downward position, and so that it has a comfortable location from which to carry the container 5 when it is in the upward position. The swing handle 28 is contoured to provide good access to a body opening 78 when it is in the upward position.

Figure 1B:
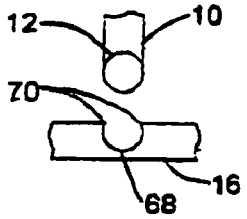
FIG. 1B is a detailed view of the flip handle attachment point.

The top of the lid 16 is shown provided with two integral hinge slots 68 in which the hinge pins 12 of the flip handle 10 are assembled. The top of the lid 16 has a recessed handle trough 18, in which the flip handle 10 sits when assembled with the lid 16. The trough 18 is formed between a set of trough rails 92. The top of the lid 16 has a set of stacking grooves 14 cut into the trough rails of the lid 16. The stacking grooves 14 are at the intersection of the trough rails 92 and an inside shoulder 36 of the lid 16. The stacking grooves 14 are circular, concentric with the diameter of the lid 16, and truncated at the edges of the trough rails 92. The flip handle 10 in the retracted position remains within the diameter of the lid 16, and does not block the stacking groove 14. The flip handle 10 may have a matching groove or indentation of sorts to prevent interference with the stacking groove 14. The flip handle 10 pivots up to 180 degrees about its hinge pins 12 when assembled in the lid 16, so that in the flipped-open position, the handle 10 protrudes from the outside of the lid 16 and can be used as a lever to turn the lid 16. FIG. 1B is a cross section view of the hinge slots 68 showing each has a smaller opening 70 than the diameter of the hinge pins 12, so that the pins 12 can be snapped into the slots 68 and become trapped therein.

Figure 2:
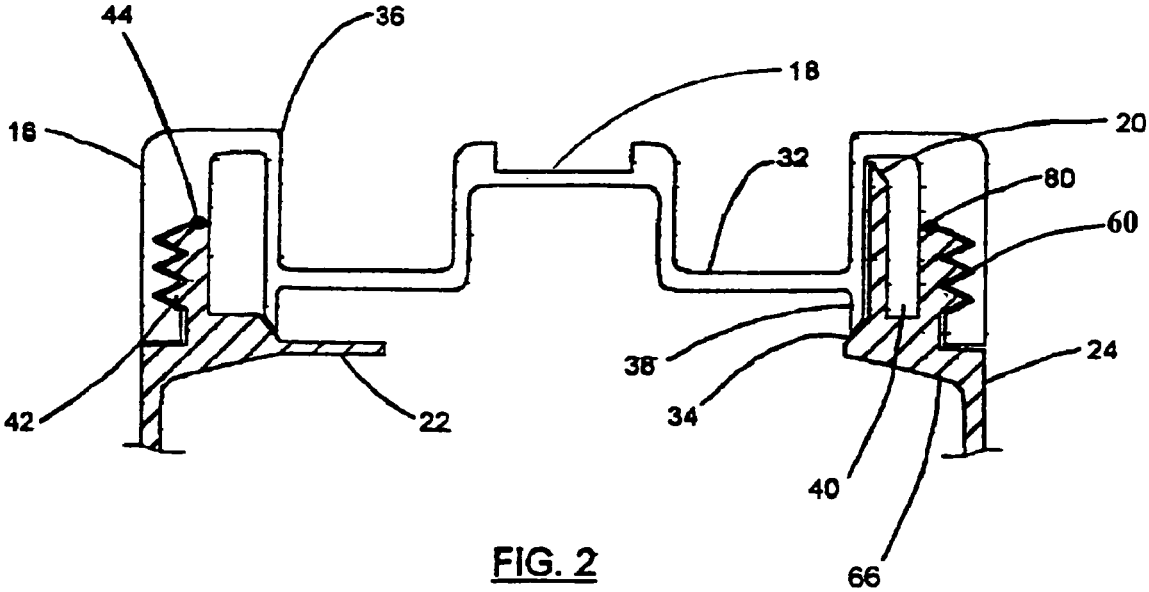
FIG. 2 is a cross section of the lid and upper container body in the closed state.

FIG. 2 shows a cross section of the lid 16 and jug upper body in the assembled state. The outer walls of the handle trough and the outside diameter wall of the stacking groove 14 extend downward and meet with a horizontal surface at the bottom to form a deeply recessed lid top 32. The recessed lid top 32 is deep enough to facilitate gripping by a hand for the purpose of manually turning the lid 16.

The flip handle 10 is wide and thick enough to withstand a lateral force used to unscrew the lid 16 from the body 24. The flip handle 10 is shown having rounded edges for user comfort. The flip handle 10, for example, may have an approximately 1-2 mm deep access cut 72 at the end opposite the hinge pins 12, and on the side of the flip handle 10 which rests on the bottom of the trough 18. The access cut 72 enables a finger or tool to be placed underneath the end of the flip handle 10 to pull it up. The flip handle 10 width is slightly smaller than the width of the handle trough 18. This is provided to prevent binding in the trough 18, yet to provide for transfer of applied turning force directly through the sides of the flip handle 10 to the lid 16 instead of to the hinge pins 12.

Figure 6:
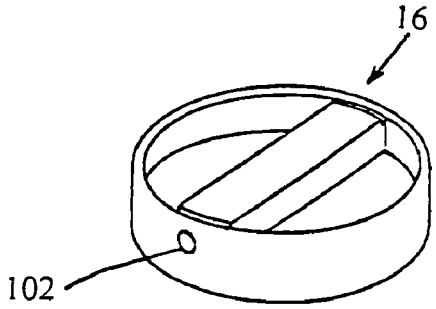
FIG. 6 is an isometric view of a lid variation without a retractable handle and a hole for an opening tool.
Figure 6B:
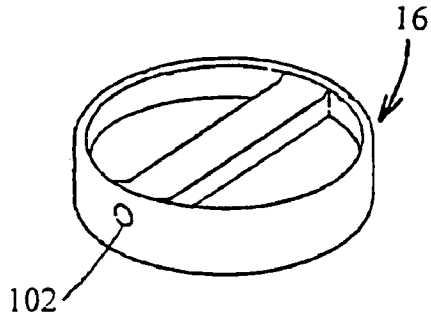
FIG. 6B is an isometric view of a lid variation in FIG. 6 designed to mate with the integral stacking ring variant shown in FIG. 4B.
Figure 6C:
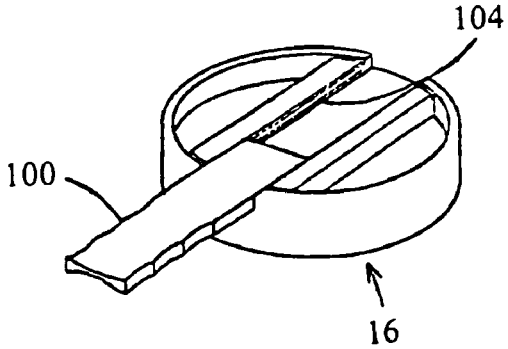
FIG. 6C is an isometric view of a sliding retractable handle variant.
Figure 6D:
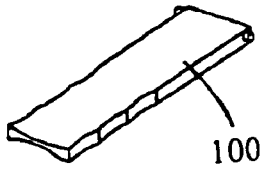
FIG. 6D is an isometric view of the handle shown in FIG. 6C.

With reference to FIG. 6, the flip handle 10 can be replaced by either a built-in sliding handle 100 or a hole 102 in the side of the lid 16. The sliding handle 100 works essentially the same way as the flip handle 10, except instead of rotating about a hinge, it slides on integral tracks 104. The version with the hole 102 is perpendicular to the lid 16 axis of rotation and large enough to accept a tool such as a screwdriver. The bit end of the screwdriver is slid into the hole 102. The screw driver handle can then be used as a lever to twist open the lid 16.

Figure 3:
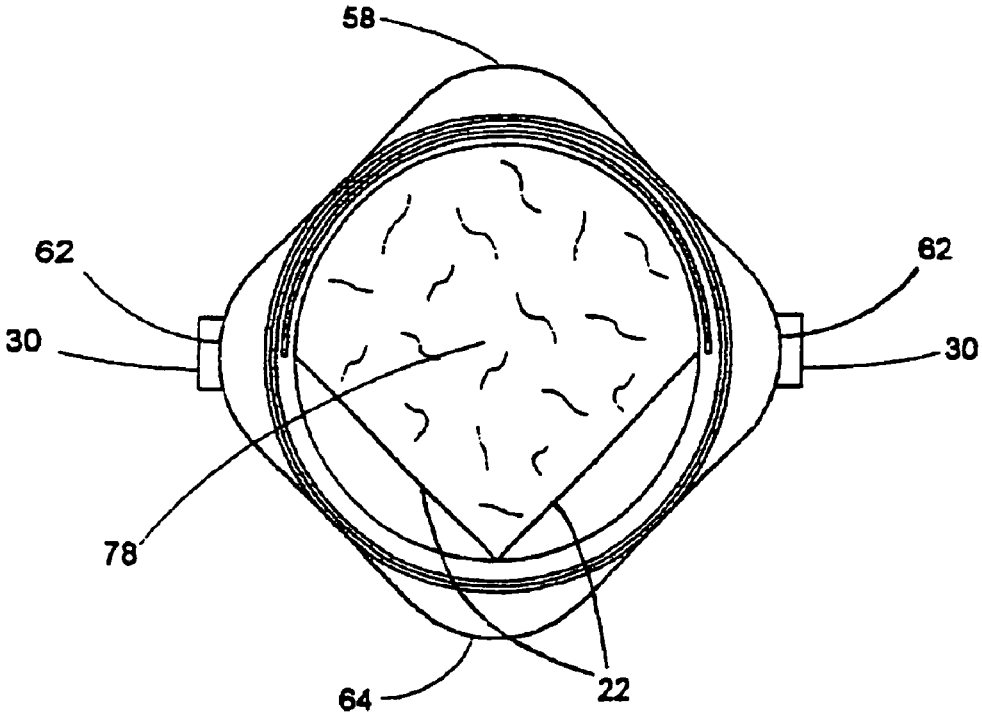
FIG. 3 is a top view of the container with the lid removed, front of the jug at the top of the figure.

The container body 24 is also illustrated as provided with an integral, hollow handle 26 recessed to fit within the overall shape of the body 24. FIG. 3 shows the preferred overall shape of the jug body 24. The integral handle 26 is shown to be within the cross section of the rounded square shape formed by the jug body 24. This provides an efficient overall shipping and shaking volume of the container 5. The preferred cube shape does not take any more box space than a cylindrical container of the same height, but it contains more volume. The width-to-height aspect ratio of the preferred form of the container 5 of the invention is approximately the same as for a conventional paint can in the side-to-side dimensions. Diagonally, corner to corner, the aspect ratio of the container 5 of the invention is lower, which increases stability on inclined surfaces.

Figure 1C:
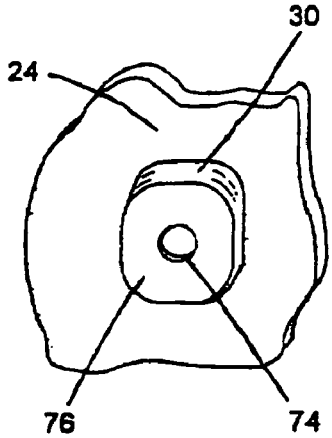
FIG. 1C is a detailed view of the rigid handle ear attachment.

In FIG. 3, rounded corners 58,62,64 of the body 24 are shown provided, thus making the lower body cross-section a rounded-corner square. The top shape, however, is circular with an external threaded collar extension 42. On the outside of the body 24 at corners 62, near the top in the area where the square shape of the body 24 transitions to circular, two handle ears 30 are shown provided. FIG. 3 shows the ears 30 as shaped close to the overall body contour, located slightly offset from the center of the corners 62. This offset is in the direction of the center of internal volume of the body 24, which is off center from the overall square shape to adjust for the volume displaced by integral handle at corner 64. A further view of the ears 30 is shown in FIG. 1C, extending from the outside surface of the body 24, providing a support surface 76 approximately parallel and connected to the body 24 on both sides and the top, but not the bottom of the surface. There is a handle hole 74 in the support surface of each ear 30. A space between the support surface and the main part of the body 24 provides room for installation of the ends of the rigid swing handle 28. The ends of the swing handle 28 are bent in an "L" shape, each in the opposite direction of the other, to prevent the swing handle 28 from falling out of the handle ears 30 once assembled with the jug body 24.

As before discussed, one of the important novel features of the container construction of the present invention resides in the dripless pouring spout 20 that can be seen in FIGS. 1 and 2 extending higher than the threaded collar portion of the body 24. The spout 20 has a smooth or rounded translation at each end, at side corners 62. The top edge of the spout 20 is tapered to a thin edge, approximately 0.2-0.5 mm thick, as shown more particularly in FIG. 2. The taper can be on either or both sides of the top edge of the spout 20. The spout 20 is located concentrically within the threaded extension of the body 24, at an approximate radial distance of 2-4 mm in the preferred prototype container of the invention. The space between the spout 20 and the threaded portion of the body 24 forms a deep groove-shaped drip catch 40, around the length of the spout 20. A conical-shaped, smooth, beveled edge 34 is adjacent to and radically inward from the base of the spout 20 as also shown in FIG. 2. The beveled edge 34 extends around the full circumference of the opening 78 at the top of the jug body 24. In the opposite half of the circle coincident with the spout 20, just below the beveled edge 34, and in the same plane as the base of the spout 20, are two straight, perpendicular chord wiping edges 22. These wiping edges 22 are shown in FIGS. 1, 2, and 3. In the preferred embodiment of the container 5 exemplified in said prototype, the body opening 78 at the top of the jug body 24 has a dimension between the wiping edges 22 and the beveled edge 34 under the spout 20 of at least 102 mm. This dimension, however, would vary for a different overall size of the container 5 of the same design.

The lid 16 has internal threads 60 that mate with the external threads on the collar extension 42 of the body 24. A circular gasket 44 is used between the lid 16 and jug body 24, near the threads of each member. The gasket 44 is made of a pliable, compressible material such as soft plastic or rubber, and seals the container 5 when assembled. The gasket 44 is installed in the lid 16 and retained there by a tightly conforming gasket groove 80. A flexible, circular splash seal 38 extends from the bottom of the lid 16 radially inside the threads, gasket 44, and spout 20, coincident with the outside wall of the recessed lid top. The beveled edge 34 of the jug body 24 forms a mating surface for the splash seal 38, which is made long enough so that the splash seal 38 will not hit the top of the wiping edges 22 when the lid 16 is screwed on the body 24. Below the wiping edges 22 on one side and the beveled edge 34 on the opposite side of the opening 78, the jug body has an inner lip 66 that is a smooth contoured transition from the inside of the body 24. The lip 66 is shaped so material poured out of the body 24 will not be trapped inside in the upside-down position.

Figure 4:
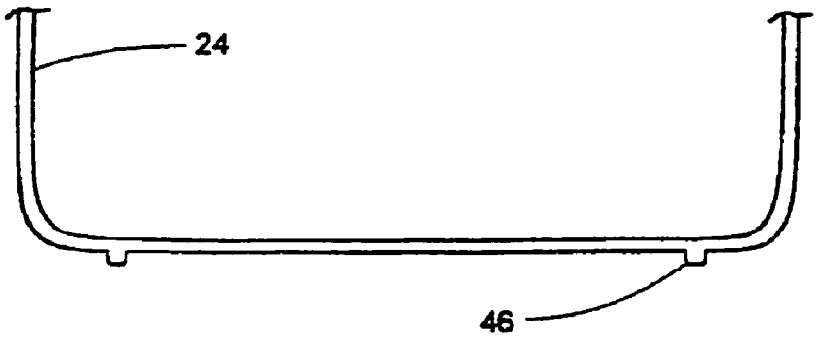
FIG. 4 is a cross section of the bottom of the container.
Figure 4B:
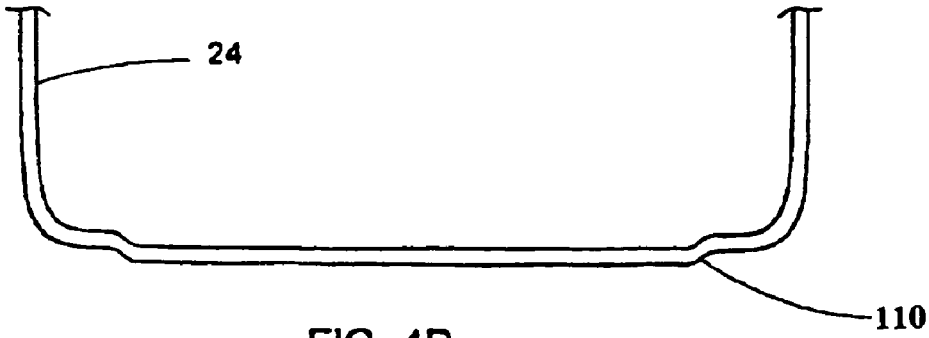
FIG. 4B is a cross sectional view of an integral stacking ring of variant shape.

FIG. 4 shows a sectional view of the bottom of the jug body 24. A protruding, full circumference integral stacking ring 46 is illustrated as extending from the bottom of the body 24. The ring 46 is sized and shaped to fit within the stacking groove 14 of the lid 16. This provides stability when one such container 5 is stacked on top of another, unlike the prior art paint cans. The flip handle 10 is grooved or shaped such that it does not interfere with the integral stacking ring 46 when stacked. The outside diameter of the integral stacking ring 46 is the same as the inside diameter of shoulder 36 such that the contact made increases lateral locking stability. In lieu of the stacking ring 46, the body may have a stacking protrusion 110 formed in the bottom, as shown in FIG. 4B.

Operation of the Container—FIGS. 1-6

The container 5 of the invention is well suited for storage and access of viscous fluids. The presence of the rigid swing handle 28 or flexible swing handle 48 and integral handle 26 allows multiple one-handed or two-handed positions when holding or carrying the container 5, or pouring material from it. The handles also allow for multiple positions, with one hand holding or carrying the container 5, while accessing the material within it through the jug body opening 78 with the other hand. The shape, size and location of the integral handle 26 also allows different relative positioning of the arm whose hand is holding the integral handle 26, either straight on, perpendicular to the container 5, or at the side, tangential to the container 5. It also allows for carrying two containers 5 with one hand, if the hand is at least average adult-sized.

The thin edge of spout 20 provides for the minimum amount of spillage from a viscous fluid poured from the container 5, which will adhere to the back surface of the spout 20 as it is tipped back to an upright position. The combination of the spout 20 extending higher than the threaded extension 42, and the gap between the spout 20 and the threaded extension 42 at drip catch 40, prevents spillage onto the sealing surface at the top of the threaded extension 42 and onto the threads themselves. This helps to keep them clean for optimal use and storage with the container 5. Drip catch 40 also provides a reservoir for, and traps such viscous fluids poured from the container 5, which otherwise would drain down the outside of the spout 20 onto the threads. In order for this arrangement to work properly, however, the drip catch 40 can not be allowed to contain too much fluid or it would pour out from that area at the same time as the main body 24 when tipped. The function of splash seal 38 is to prevent this from happening.

This splash seal 38 prevents any significant amount of fluid from getting into the drip catch 40 or on the sides of the threaded extension 42 when lid 16 is on. As the lid 16 is screwed on, the splash seal 38 engages with beveled edge 34 at the same time the lid 16 engages with gasket 44. The gasket 44 compresses as the lid 16 is turned further, providing a seal for the container 5. As the gasket 44 compresses, the splash seal 38 flexes inward down the beveled edge 34 until the lid 16 is completely seated against the threaded extension 42. This way, by keeping the drip catch 40 and inside surface of the threaded extension 42 free of fluid material, external threads 42 and gasket 44 will remain clean so long as the container 5 is only tipped to pour material out in the direction of the spout 20. To illustrate further, if a significant amount of fluid is allowed to get into the drip catch 40, this fluid could then pour out over the top sealing surface of the threaded extension 42 and onto the threads the next time the container 5 is tipped for pouring. Preventing fluid from getting into those areas, in accordance with the construction of the present invention, allows for shaking the container 5 to mix internal fluids, or for other normal uses, while assuring the gasket sealing surface and threads stay relatively clean.

One way a person can open or close the lid 16 of the container 5 is simply to grasp the lid 16 around the flip handle 10 in the half-moon shaped sections of recessed lid top 32 with one hand, and the integral handle 26 with the other, and turn the lid 16. Alternately, flip handle 10 assembled in the lid 16 is used for leverage in manually screwing the container 5 open or closed. First a person uses a finger (or, if available, a small a tool such as a screwdriver) to flip open the flip handle 10 all the way. Then the person grasps the integral handle 26 with the other hand and applies a force to the flip handle 10 while taking the reaction out with the hand at the integral handle 26. Obviously, the flip handle 10 and recessed handle of the lid 16 can be used concurrently if convenient to do so.

Access to the material inside the container 5 is provided through the opening 78. Wiping edges 22 are provided for wiping off a brush or the like dipped into the fluid in the container 5, such that the fluid wiped off the brush or other device, will drain back into the container 5. The material in the container 5 may also be poured out completely, which is facilitated by inner lip 66 which provides a smooth geometry that will not trap any fluid in the upside-down container position.

A plurality of the containers 5 may be stacked on top of one another for storage in a stable fashion, facilitated by the stacking groove 14 in the lid 16 and integral stacking ring 46 on the bottom of the jug body 24, as before described.

Alternate Constructions

In order to provide a more producible version of the container 5, it may be desired to make the jug body 24 out of two separate pieces, and then use a commercially available adhesive or fasteners integrally to connect them. One likely separation point is at the interface between the externally threaded extension 42 at the top of the body 24 and the remaining features radially inside it. This corresponding inner piece would consist of the wiping edges 22, the beveled edge 34, the spout 20, and potions of the bottom surface of the drip catch 40 and of the inner lip 66. The pieces may then be able to be fabricated with other less expensive techniques than blow molding or injection molding or with less expensive tools and machines. Similarly, the lid 16 and flip handle 10 may be fabricated by other means as opportunity allows for improved costs, such as stamping or extrusion.

To provide a stronger hinge pin on the flip handle 10, it may be desirable to construct it out of a metal material such as stainless steel. In its place, in the handle, would be tight fitting hole, in which two separate hinge pins or one long pin through the handle would be installed.

Figure 5:
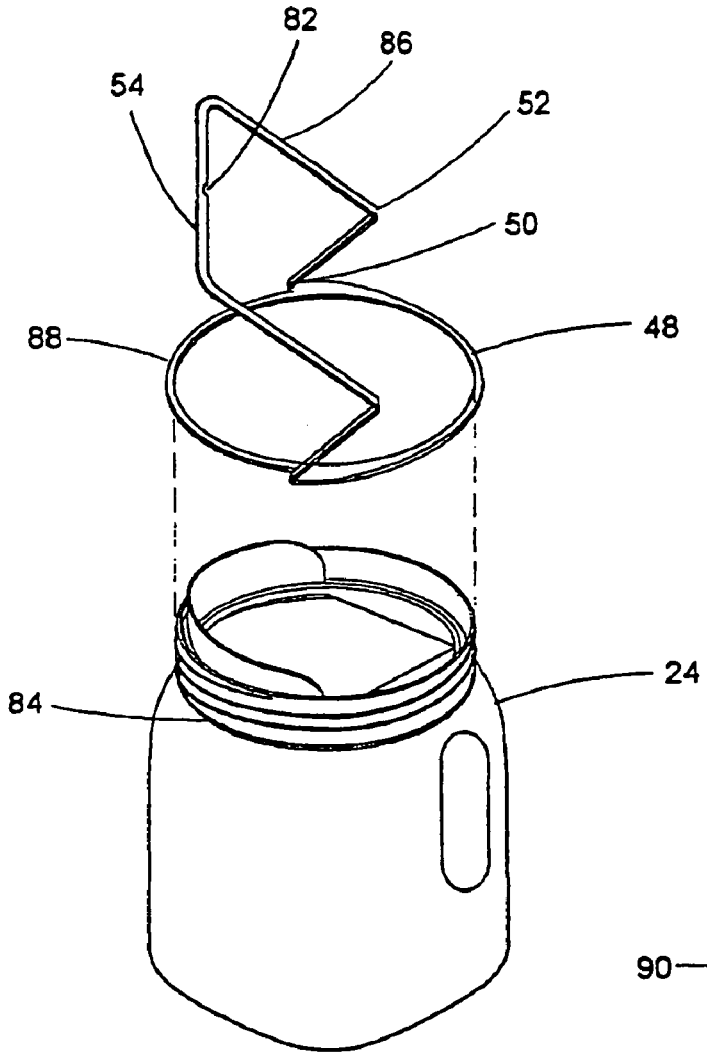
FIG. 5 is an isometric view of the container and a flexible swing handle variant.

FIG. 5 illustrates an alternate embodiment of the container 5. In this version, a flexible swing handle 48 is mounted at the top of the jug body 24. The flexible swing handle 48 is made of a thick, flexible plastic such as polyethylene, polypropylene, vinyl, or nylon, which allows for repetitive bending and flexing without yielding or breaking. The flexible swing handle 48 has a circular base 88 for mounting on the jug body 24 and two parallel legs 86 extending off the base 88 on opposite sides. Each leg 86 has two locally thinned or pre-grooved sections at a base joint 50 and a mid-joint 52 that act as hinges and allow the flexible swing handle 48 to lay down on the side of the body 24 when it is at rest. It has a straight, integral, swing handle grasp 54 connecting the two legs 86 with a small indentation or curved notch 82 in the center of the grasp 54. The notch 82 can be used to hang the container 5 using a common existing accessory tool used for such purposes, such as a ladder-rung hook. The inside diameter of the base 88 is slightly smaller than the outside diameter of the threaded extension 42 of the body 24, and mounts in a small circumferential groove 84 just below the threads. The flexible swing handle 48 can be rotated or fixed in its installed position to move the relative position of the handle grasp 54.

Figure 5B:
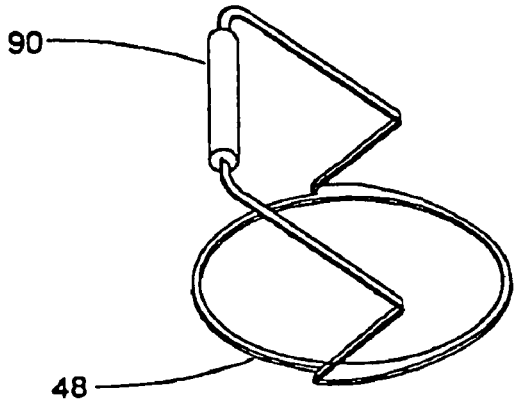
FIG. 5B is an isometric view of a flexible swing handle with a grip pad.

The same flexible swing handle 48 is shown in FIG. 5B with an optional flexible handle grasp pad 90 installed similarly to the swing handle grasp pad 56 that was described in the main embodiment version. The operation of these alternate swing handle versions is similar to that previously described. The flexible swing handle 48 may be rotated in its installed position to change the position of the handle grasp 54 relative to the spout 20, jug body opening 78, or other features in the jug body 24. The handle grasp 54 can be neatly stowed against one of the flat sides of the jug body 24 when in the downward resting position.

Further modifications will also occur to those skilled in this art, and such are deemed to fall within the spirit and scope of the invention as defined in the appended claims.

Advantages of the Container of the Present Invention

In its objective for improving the dispensing, containment, and handling of fluids such as architectural coatings and the like, the container 5 of the present invention has been particularly optimized for paints, wherein dispensing involves the opening, distribution of contents by pouring or extracting with a scoop or brush, cleaning, and closing of the container 5. Current paint cans, as before explained, require the use of tools such as a screwdriver or the like for opening the lid. Screwdrivers often damage paint can lids and ruin the can seal. Prying open the lid becomes more difficult, furthermore, the more the can is used. It is much easier to open the lid 16 of the present invention because it is screwed on, and has built-in leverage to tighten and loosen it, and has design features in the opening and spout 20 of the container 5 to prevent the threads from getting contaminated with the fluid from inside. No additional tools are needed, and the handles that are provided for leverage fully retract within, or are already integrally part of the container 5. Once the lid 16 is rotated approximately one third of a turn, the friction seal is released and little resistance is left. An additional recessed lid grip is then used quickly and easily to unscrew the lid the rest of the way, until open.

The present invention substantially eliminates paint from reaching the exterior surface of the container 5 during pouring through its spout design that is optimized essentially to eliminate dripping onto the container exterior, specifically on the threads or label. Its unique shape minimizes dribble over the spout; and a non-draining groove or trough behind the spout traps what little dribble may somewhat occur. Pouring, in accordance with the invention, is thus a vastly cleaner operation that requires little or no clean-up before closing.

The invention also improves pouring accuracy and comfort, as well. The spout 20 pours more uniformly than a conventional paint can. The fluid stream is narrower and more cylindrical. This enables more accurate pouring. The use of the integral handle 26 and swing handle 28 or 48 during pouring is more comfortable than holding a paint can by the bail and can bottom. The handles also provide better control, which also improves pouring accuracy.

The design of the present invention, furthermore, improves dispensing of paint by brush. A brush is typically wiped on one or both sides to remove excess paint after it is dipped into the can. When a brush is wiped against the cylindrical opening of a conventional paint can, only excess paint from the edges is removed. The invention provides two straight wiping edges 22 at the back of the opening 78 at right angles to each other. Being straight, the wiping edges 22 remove excess paint uniformly from the brush as it is wiped. The edges being only 90 degrees apart, makes the wiping of both sides more convenient with less hand motion due to being closer together. A brush wiped against a conventional paint can opening must be moved across the entire opening, which is less convenient.

Many users, moreover, hold paint cans as they brush. The bail and associated can geometry is uncomfortable. The integral handle 26 of the invention, on the other hand, can be held in two positions. One method is to grasp the handle 26 as one would any vertical handle, such as one commonly seen on a plastic gallon milk jug. The other method is to put one's fingers through the integral handle 26, palm towards the jug, and grasp the container 5 with the hand. Each method is significantly more comfortable than holding a conventional paint can.

As before intimated, conventional paint cans may require a hammer or similar tool for closing. This often damages the friction lid and ruins the seal. As mentioned before, paint splatter is common due to paint left in the trough. After sufficient drying time between repeated uses, dried paint can completely foul the friction lid seal and render the paint can useless for storage. If the lack of seal is not identified by the user, the contents may congeal or solidify in storage. Closing and resealing the container 5 of the invention is vastly improved since its threads and sealing surfaces remain clean after use. As a result, it will store fluids longer and keep them from becoming contaminated or drying out. The spout 20 and screw on the lid 16, in addition, eliminates any pooling of paint that could cause splattering or fouling of the seal. The built-up flip handle 10, recessed lid grip, and integral handle 26 in its body eliminate the need for any tools for closing.

The design of the container 5 of the invention also improves containment. Fouling of the seal is eliminated and thus preservation of contents is assured. The improved sealing features of the device ensure endurance of the paint quality. The container 5 is preferably of plastic, so the formation of rust, which is common on paint cans, is eliminated. The invention also has the splash seal 38 inside the lid 16 that isolates the container opening 78 from the spout 70 and sealing surfaces. This seal blocks paint from reaching the gasket seal 44 and the spout 20 of the container 5 during handling and shaking. By keeping these two items free of paint, seal integrity and clean pouring are respectively maintained far better than with a conventional paint can.

Hand transport and general handling of the container 5 of the invention is also superior to conventional paint cans. The user has a choice of using the integral handle 26 or an exterior, rigid swing handle 28 depending on the situation. The rigid swing handle 28 offers the same conveniences as the bail on conventional paint cans. The integral handle 26 is more comfortable, sturdy, and offers more control over the container 5 when it is full.

What is claimed is:

1. An apparatus comprising:

a first container comprising a unitary main body with a threaded neck portion and a sidewall, the unitary main body also comprising a handle portion having opposite ends each of which extends from the main body, the handle portion comprising a molded handle wherein the molded handle and the main body define an opening for receiving fingers of a human hand, the handle portion extending along the side of the unitary main body wherein the handle portion and the unitary main body define a perimeter of the first container;

the unitary main body further comprising a ring and a bottom portion, the ring projecting downwardly from the bottom portion and having a vertical interior surface, said vertical interior surface of said ring and said bottom portion defining a recess located centrally in the bottom portion, the recess defined by a surface free of an interlocking extension, and a lid, the lid attachable to the threaded neck portion of the unitary main body, wherein the threaded neck portion is disposed centrally with respect to the main body;

the recess of the first container adapted to align the first container with a lid of another container;

the lid of the first container including a planar top surface adapted to support a second container stacked thereon and a skirt extending from the perimeter of the planar top surface, the skirt having an outer surface which is free of an interlocking extension;

the second container comprising a unitary main body with a threaded neck portion and a sidewall, the unitary main body also comprising a handle portion having opposite ends each of which extends from the main body, the handle portion comprising a molded handle wherein the molded handle and the main body define an opening for receiving fingers of a human hand, the handle portion extending along the side of the unitary main body wherein the handle portion and the unitary main body define a perimeter for the paint container; the unitary main body of the second container further comprising a ring and a bottom portion, wherein the bottom portion comprises a horizontal surface and the ring projects downwardly from the horizontal surface and the ring has a vertical interior surface, said vertical interior surface of said ring and a portion of said horizontal surface defining a recess located centrally in the bottom portion, a lid of the second container attachable to the threaded neck portion of the unitary main body, wherein the threaded neck portion is disposed centrally with respect to the main body;

the recess of the second container adapted to align the second container with the lid of the first container, the vertical interior surface of the second container being free of interlocking extensions;

the lid of the second container including a top surface adapted to support another container stacked thereon;

wherein the horizontal surface of the second container comprises a substantial area of the bottom portion of the second container; wherein the horizontal surface of the bottom portion of the second container faces the planar top surface of the lid of the first container; wherein the second container rests on the lid of the first container and the lid of the first container supports substantially all of the weight of the second container in a stable stacked arrangement, and further wherein, the horizontal surface of the bottom portion of the second container is parallel to and proximate to the planar top surface of the lid of the first container; and the first and second containers are configured to contain paint.

2. The apparatus of claim 1 wherein the lid of the first container and the lid of the second container include an o-ring positioned to seal their respective lids to their respective main bodies.

3. The apparatus of claim 2 wherein the lid of the first container and the lid of the second container each define one or more discrete indentations.

4. The apparatus of claim 1 wherein the lid of the first container and the lid of the second container each comprise a unitary band.

5. The apparatus of claim 4 wherein the first and second containers include a flip handle having indentations.

6. The apparatus of claim 1 wherein the lid of the first container and the lid of the second container define indentations.

7. The apparatus of claim 6 wherein the handle portion of the first container and the handle portion of the second container are hollow.

8. The apparatus of claim 6 wherein the handle portion of the first container and the handle portion of the second container are integral to their respective main bodies.

9. The apparatus of claim 8 wherein the first and second containers are treated to resist oil-based materials.

10. The apparatus of claim 1 wherein the second container is adapted so that the sidewall of the second container contacts the handle of the first container when positioned adjacent thereto and the perimeter of the first and second container in contact is rectangular.

11. The apparatus of claim 1 wherein the main body of the first and second containers comprise a polymer.

12. The apparatus of claim 1 wherein the lid of the second container includes a stacking groove to receive the ring.

13. The apparatus according to claim 12 wherein the stacking groove is annular.

14. The apparatus according to claim 1 wherein the skirt extends downwardly from the planar top surface of the lid.

15. An apparatus comprising:

A. at least first, second, and third containers;

B. the first container comprising:

(1) a unitary main body with a threaded neck portion and a sidewall, (2) the unitary main body also comprising a handle portion having opposite ends each of which extends from the unitary main body, (3) the handle portion comprising a molded handle, wherein:

(a) the molded handle and the unitary main body define an opening for receiving fingers of a human hand;

(b) the handle portion extends along the side of the unitary main body;

(c) the handle portion and the unitary main body define a perimeter of a paint container;

(d) the unitary main body further comprises a ring and a bottom portion, the ring projecting downwardly from the bottom portion and having a vertical interior surface;

(e) said vertical interior surface of said ring and said bottom portion define a recess located centrally in the bottom portion;

(f) the recess is defined by a surface free of an interlocking extension;

(g) a lid is attachable to the threaded neck portion of the unitary main body;

(h) the threaded neck portion is disposed centrally with respect to the unitary main body;

(i) the lid of the first container includes a planar top surface adapted to support the second container stacked thereon;

(j) a skirt extends from the perimeter of the planar top surface; and (k) the skirt has an outer surface which is free of an interlocking extension;

C. the second container comprising:

(1) a unitary main body with a threaded neck portion and a sidewall, (2) the unitary main body also comprising a handle portion having opposite ends each of which extends from the unitary main body, (3) the handle portion comprising a molded handle, wherein:

(a) the molded handle and the unitary main body define an opening for receiving fingers of a human hand:

(b) the handle portion extends along the side of the unitary main body;

(c) the handle portion and the unitary main body define a perimeter for a paint container;

(d) a lid of the third container is attachable to the threaded neck portion of the unitary main body;

(e) the threaded neck portion is disposed centrally with respect to the unitary main body;

(f) the lid of the third container includes a planar top surface;

(g) a skirt extends from the perimeter of the planar top surface; and (h) the skirt has an outer surface which is free of an interlocking extension; and D. the third container comprising:

(a) a unitary main body comprising a bottom portion and a ring projecting downwardly from a horizontal surface of the bottom portion, wherein:

(b) the ring is proximate to a perimeter of the bottom portion of the second container and has a vertical interior surface;

(c) the vertical interior surface and a portion of said horizontal surface define a recess adapted to align the second container with the lid of the first container;

(d) the vertical interior surface of the second container is free of interlocking extensions;

(e) the horizontal surface of the second container faces the planar top surface of the lid of the first container;

(f) the horizontal surface of the second container is parallel to and proximate to the planar top surface of the lid of the first container;

(g) the second container rests on the lid of the first container; and (h) the lid of the first container supports substantially all of the weight of the second container in a stable stacked arrangement.

16. The apparatus according to claim 15 wherein:

(a) the horizontal surface of the bottom portion of the second container comprises a planar surface extending outwardly from the second ring and (b) the planar top surface of the lid of the first container faces the horizontal surface of the bottom portion of the second container.

17. The apparatus according to claim 16 wherein the planar top surface of the lid of the first container abuts the horizontal surface of the bottom portion of the second container.

18. The apparatus according to claim 15 wherein:

(a) the horizontal surface of the bottom portion of the second container comprises a planar surface extending outwardly from the second ring and (b) the planar top surface of the lid of the first container abuts the horizontal surface of the bottom portion of the second container.

* * * * *